US009694576B2

(12) United States Patent
Norasak et al.

(10) Patent No.: US 9,694,576 B2
(45) Date of Patent: Jul. 4, 2017

(54) METHODS FOR JETTING HIGH VISCOSITY FLUIDS

(71) Applicant: FUNAI ELECTRIC CO., LTD, Osaka (JP)

(72) Inventors: Sam Norasak, Lexington, KY (US); Stephen T. Olson, Lexington, KY (US); Ajay K. Suthar, Lexington, KY (US)

(73) Assignee: Funai Electric Co., Ltd. (JP)

( * ) Notice: Subject to any disclaimer, the term of this patent is extended or adjusted under 35 U.S.C. 154(b) by 0 days.

(21) Appl. No.: 14/940,191

(22) Filed: Nov. 13, 2015

(65) Prior Publication Data

US 2017/0136766 A1 May 18, 2017

(51) Int. Cl.
*B41J 29/38* (2006.01)
*B41J 2/045* (2006.01)

(52) U.S. Cl.
CPC ..... *B41J 2/04571* (2013.01); *B41J 2/04586* (2013.01)

(58) Field of Classification Search
CPC .. B41J 2/0458; B41J 2/04563; B41J 2/04588; B41J 2/04528; B41J 2/04581; B41J 2/04553; B41J 2/0454; B41J 2/04573; B41J 2/04598; B41J 2/04541; B41J 2/355; B41J 2/04543; B41J 2/04571; B41J 2/04586
USPC ..... 347/9, 10, 11, 14, 17, 19, 57, 60, 194, 347/54, 56
See application file for complete search history.

(56) References Cited

U.S. PATENT DOCUMENTS

| | | | |
|---|---|---|---|
| 5,182,572 | A | 1/1993 | Merritt et al. |
| 7,070,262 | B2 | 7/2006 | Yamamoto et al. |
| 7,681,966 | B2 | 3/2010 | Parker et al. |
| 8,042,935 | B2 | 10/2011 | Hart |
| 2002/0036672 | A1 | 3/2002 | Courtney et al. |
| 2003/0016258 | A1 | 1/2003 | Anderson et al. |
| 2006/0038862 | A1 | 2/2006 | Tanno |
| 2013/0033549 | A1 | 2/2013 | Barton et al. |

*Primary Examiner* — Jannelle M Lebron
(74) *Attorney, Agent, or Firm* — Luedeka Neely Group, PC

(57) ABSTRACT

Methods for ejecting fluids having a viscosity ranging from about 20 mPa-sec to about 100 mPa-sec at 22° C. from a micro-fluid ejection head. The methods include the steps of applying a heat signal to the ejection head for a first period of time to heat the ejection head to a first temperature that is about 20° C. above a steady state fluid ejection temperature for continuous or intermittent fluid ejection from the ejection head; and subsequently, applying a firing signal to ejection heaters on the ejection head during which fluid ejection from the ejection head occurs.

15 Claims, 3 Drawing Sheets

METHODS FOR JETTING HIGH VISCOSITY FLUIDS

TECHNICAL FIELD

The disclosure is directed to methods for reliably jetting fluids onto a substrate, into the atmosphere or into a gas, into a liquid, or onto a solid material and in particular to methods for improving the reliability of jetting micro-fluidic quantities of relatively high viscosity fluids using micro-fluid thermal jet heads.

BACKGROUND AND SUMMARY

Ink jet technology with aqueous inks is very well understood when jetting fluids of 1-5 mPa-sec or less. New applications using non-aqueous fluids as well as aqueous fluids with viscosities up to 100 mPa-sec present new challenges both for steady state jetting of fluids and during an initial fluid jetting start after a period of non-ejection of fluid. Fluids will often fail to eject from micro-fluid jet heads when the jet head ejection nozzles or jet heads are left uncapped for relatively short periods of time without a wiping or maintenance step built into the ejection sequence despite previous ejection from the jet heads. The foregoing ejection problem may be aggravated by increased viscosity of the fluid being jetted. Accordingly, the initial ejection of higher viscosity fluids from an uncapped ejection head is a challenge to the use of relatively high viscosity fluids in a micro-fluidic ejection device. By "high viscosity" is meant viscosities in the range of from about 20 to about 100 mPa-sec or higher at about 22° C. Furthermore, such high viscosity fluids are often required to be used in environments of temperature and humidity that are outside traditional limits of temperature and humidity used by ink jet printer and print head manufactures. Applications for jetting high viscosity fluids may include, but are not limited to, high viscosity inks, adhesives, adhesive components, solid-to liquid phase change compositions, pharmaceuticals, aroma enhancing compounds, and the like. Accordingly, there is a need for micro-fluid ejection heads that are adapted for use with relatively high viscosity fluids.

Embodiments of the disclosure provide methods for ejecting fluids having a viscosity ranging from about 20 mPa-sec to about 100 mPa-sec at 22° C. from a micro-fluid ejection head. The methods include the steps of applying a heat signal to the ejection head for a first period of time to heat the ejection head to a first temperature that is about 20° C. above a steady state fluid ejection temperature for continuous or intermittent fluid ejection from the ejection head; and subsequently, applying a firing signal to ejection heaters on the ejection head during which fluid ejection from the ejection head occurs.

In one embodiment, the method for ejecting a high viscosity fluid for a first time from a newly filled micro-fluid ejection head or after an ejection head idle period of 60 minutes or more includes the steps of pre-heating the ejection head to a temperature ranging from about 60° C. to about 100° C. and maintaining the temperature for a first period of time ranging from about 30 to about 60 seconds by applying a pre-heat signal to one or more substrate heaters on the ejection head; applying a fluid ejection signal to the ejection head subsequent to the pre-heat signal to eject drooling fluid from the ejection head, wherein the fluid ejection signal has a pre-fire pulse of 250 to 350 nanoseconds (nsec), a dead time of 1200 nsec, and a firing pulse 750 to 1000 nsec; subsequently, applying a heat signal to the one or more substrate heaters on the ejection head for a period of time ranging from about 3 to about 6 seconds to heat the ejection head to a temperature that is about 20° C. above a steady state fluid ejection temperature for continuous or intermittent fluid ejection from the ejection head; and subsequently, applying a firing signal to the ejection heaters on the ejection head during which steady state fluid ejection from the ejection head occurs.

In another embodiment, a method for ejecting a solid material having a melting point of from about 20° to about 30° C. from a micro-fluid ejection head is provided. The method includes the steps of heating the solid material in a container for the material that is adjacent to the ejection head to a temperature sufficient to provide a flowing liquid having a viscosity of from about 20 to about 100 mPa-sec; applying a heat signal to one or more substrate heaters on the ejection head for a first period of time to heat the ejection head to a first temperature that is about 20° C. above a steady state fluid ejection temperature for continuous or intermittent fluid ejection from the ejection head; and subsequently, applying a firing signal to ejection heaters on the ejection head during which fluid ejection from the ejection head occurs, wherein the firing signal has a pre-heat pulse of 200 to about 300 nanoseconds (nsec) a dead time of about 1200 nsec and a firing pulse of 700 to about 950 nsec.

The foregoing methods are particularly suitable for the initial ejection of fluids having high viscosity from a thermal fluid ejection head that is being used for the first time, that has been initially filled with high viscosity fluid, or that has cooled down below about 30° C. due to non-use of the ejection head. The fluids may be liquid below about 30° C. or may be materials that go through a phase change from solid to liquid. A modified procedure, described in more detail below, may be used when the ejection head is at a temperature ranging from above about 30° C. to below about 50° C. An advantage of the disclosed methods is that the procedure is effective to initiate ejection of a high viscosity fluid from a micro-fluid ejection head without the need for thermal ejection head wipers or elaborate maintenance procedures, such as the use of suction to clear any fluid plugs in nozzles and flow feature of the ejection head.

BRIEF DESCRIPTION OF THE DRAWINGS

Further advantages of the embodiments will become apparent by reference to the detailed description of exemplary embodiments when considered in conjunction with the drawings, wherein like reference characters designate like or similar elements throughout the several drawings as follows.

DETAILED DESCRIPTION OF EXEMPLARY EMBODIMENTS

Figure 1:
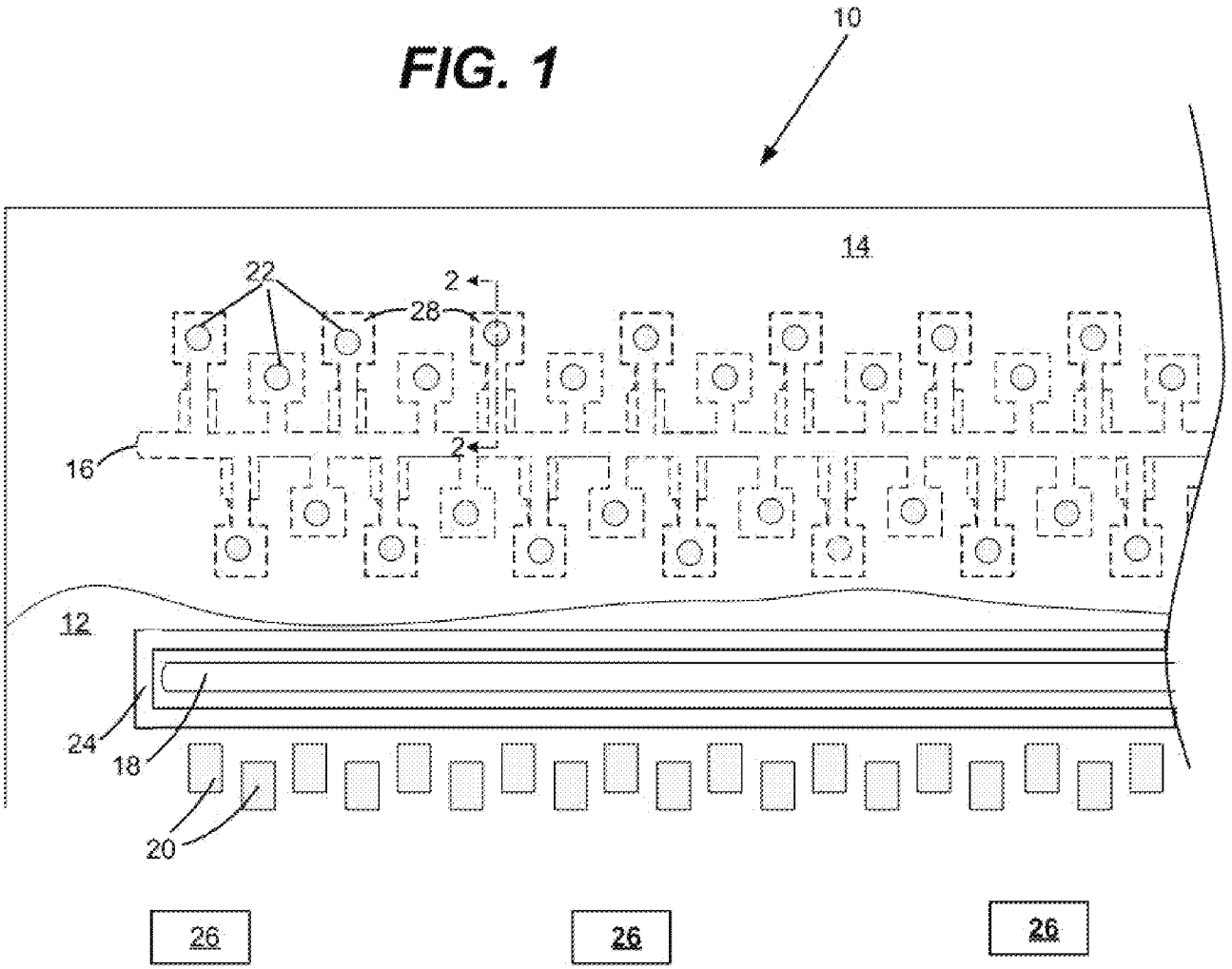
FIG. 1 is a plan view, not to scale, of a portion of a thermal micro-fluid ejection head.

A plan view of a portion of a thermal micro-fluid ejection head 10 is illustrated in FIG. 1. The ejection head 10 includes a silicon substrate 12 and a nozzle plate 14 attached to the substrate 12. The substrate 12 may include a single fluid feed slot or multiple fluid feed slots 16 and 18. A plurality of ejection devices, such as resistor heaters 20 are adjacent the slots 16 and 18. Upon activation of the ejection devices 20, fluids are ejected through nozzle holes 22 in the nozzle plate 14. The substrate 12 may also include substrate heaters 24 that circumscribe the feed slots 16 and 18 for pre-heating the substrate. One or more temperature sensors 26 may be included on the substrate to provide temperature feedback to control logic for maintaining the substrate 12 at a predetermined operating temperature.

Figure 2:
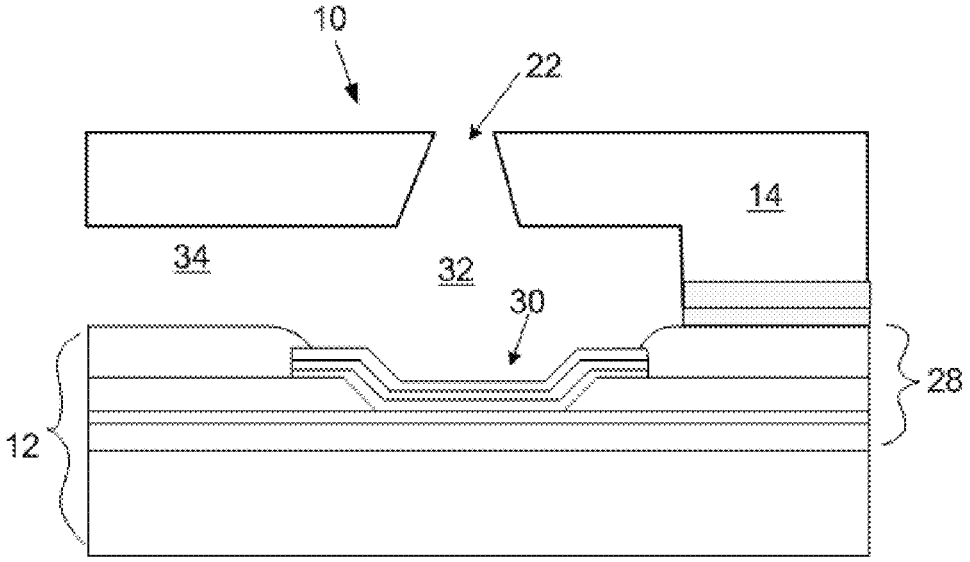
FIG. 2 is a cross-sectional view, not to scale, of a portion of the micro-fluid ejection head of FIG. 1.

A cross-sectional view, not to scale, of a portion of the thermal micro-fluid ejection head 10 is illustrated in FIG. 2. The silicon substrate 12 includes a plurality of layers 28 on the device side thereof defining the plurality of heater resistors 30. The nozzle plate 14 includes nozzle holes 22, a fluid chamber 32 and a fluid channel 34, collectively referred to as flow features, in fluid flow communication with the slot 16 for providing fluid to the heater resistor 30. As the viscosity of fluid supplied to the ejection head 10 increases, the flow rate of fluid to the heater resistors 30 decreases, accordingly, the ejection head for ejecting a high viscosity fluid may have an ejection frequency ranging from about 0.75 to about 5 kilohertz, such as from about 1 to about 3 kilohertz rather than the ejection frequency used for a conventional thermal micro-fluid ejection head which may range from 25 to 50 kilohertz or higher.

Because the flow features of a thermal micro-fluid ejection head are typically microscopic, it is relatively easy for high viscosity fluids to plug one or more of the fluid supply slot 16, fluid flow channel 34, fluid chamber 32, and/or nozzle hole 22. Such fluid plugging is particularly problematic when the micro-fluid ejection head has been idle for a period of time sufficient to allow the ejection head to cool below a predetermined temperature.

Figure 3:
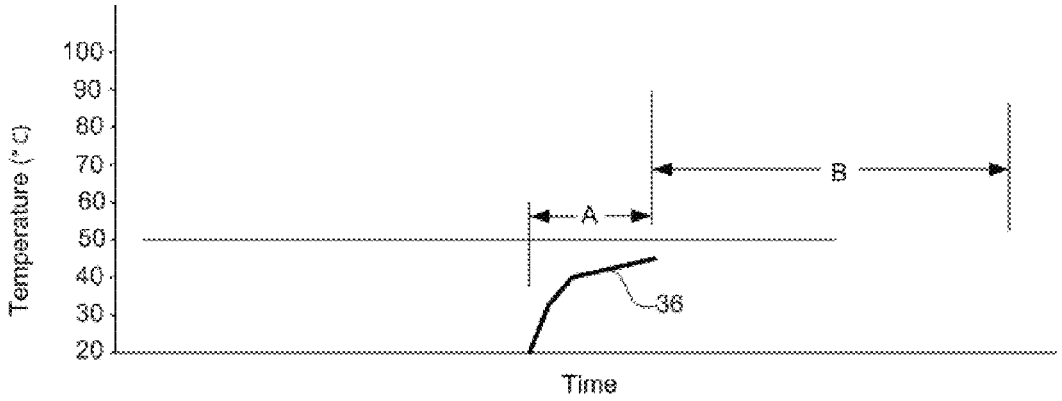
FIG. 3 Prior Art
FIG. 3 is a temperature profile, not to scale with respect to time, of a thermal micro-fluid ejection head using a conventional pre-heat procedure.

With reference to FIG. 3, an ejection head temperature profile for pre-heat and fluid ejection is illustrated for ejection of a fluid having a viscosity in the range of from about 1 to about 5 mPa-sec using a conventional pre-heat procedure. The initial pre-heat step A is relatively short, such as from about 100 to about 500 milliseconds, and does not enable the ejection head to reach a minimum temperature for ejection of a high viscosity fluid before the fluid ejection step B begins as illustrated by ejection head temperature curve 36. Firing pulses of about 500 to about 900 nanoseconds (nsec) are typically used to eject fluid from the ejection head.

Figure 4:
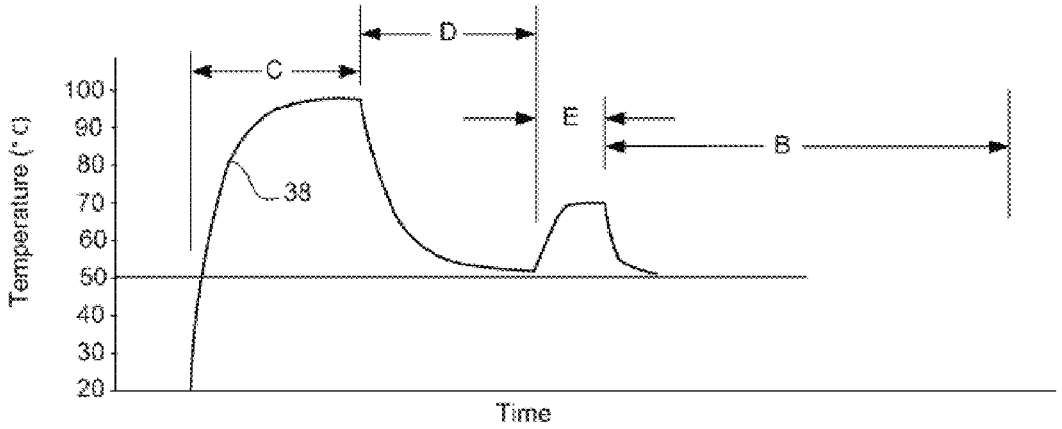
FIG. 4 is a temperature profile, not to scale with respect to time, of a thermal micro-fluid ejection head using a pre-heat procedure according to the disclosure.

FIG. 4 shows an ejection head temperature curve 38 for an ejection head 10 using the procedure of the present disclosure, wherein the time axis is not to scale so that the process steps can be seen more clearly. According to embodiments of the disclosure, when the ejection head 10 is filled with fluid to be ejected for the first time or when the ejection head 10 is used after an idle period of about 60 minutes or more, the ejection head 10 is heated from an ambient temperature to substantially above the desired operating temperature for fluid ejection and typically up to a temperature ranging from about 60° to about 150° C. during a pre-heat step C. The substrate heaters 24, described above may be used to heat the ejection head. For example, when the high viscosity fluid is comprised of a mixture of miscible liquids where one of the liquids is water and the other is a high viscosity fluid with a viscosity of about 1500 mPa-sec at 25° C. a temperature of up to about 150° C. may be used in step C. Typically, the temperature may be up to 100° C., and desirably below about 100° C. for step C.

The primary procedure used to pre-heat the ejection head 10 in step C is by heating the silicon substrate 12 through the use of one or more substrate heaters 24 taking advantage of the high heat transfer conductivity of the silicon substrate 12. The goal of the pre-heating step C is to raise the temperature of the jetting fluid and reduce the fluid's viscosity and/or surface tension. Step C may use a total heating time of from about 30 to about 60 seconds to heat the fluid and lower the viscosity of the fluid. Control logic in combination with the temperature sensors 26 may be used for on/off control of the substrate heaters 24 during the pre-heat step C.

If the substrate temperature is too low prior to the fluid ejection step B, reliable jetting of fluid from the ejection head 10 may be hampered due to longer fluid refill times or plugging of the flow features in the ejection heads. Longer refill times for fluid to the ejection head 10 may result in misfiring from a nozzle, reduced fluid droplet volumes, low fluid ejection velocity, fluid droplet misdirection, and the like. The amount of a typical fluid droplet for a high viscosity ink formulation may range from about 2000 picograms for color inks to about 16,000 picograms for black inks. Corresponding fluid droplet diameters may range from about 14 μm to about 29 μm. Other fluids may have droplet amounts above or below the foregoing amounts depending on the viscosity of the fluid.

When the ejection head is first filled with a high viscosity fluid or when no high viscosity fluid has been previously ejected from the ejection head, the back pressure is typically low in the ejection head. Hence, heating the fluid in step C may cause the fluid to drool from the nozzle holes 22. Accordingly, step D may be used is a preventative step to eject drooled fluid, if any, out of the nozzles 22 immediately adjacent to the surface of the ejection head 10 that was heated. During step D, a pulse train that includes a pre-fire pulse of 250 to 350 nsec, a dead time of 1200 nsec and a jetting pulse of 750 to 1000 nsec, may be used as the preventive step for drool mitigation in order to generate a vapor bubble and dislodge any drooling fluid from the ejection head prior to any steady state ejection step B. The pulse train in step D is applied to the heater resistors 30. The target temperature for step D is equal to the steady state temperature that will be used in step B for ejecting fluid from the ejection head. Step D is substantially shorter than step C and may last only about 3 to about 6 seconds.

In step E, the ejection head is re-heated to heat any fluid that may have cooled slightly during step D by using the substrate heaters 24 described above. Step E has a duration that is also much shorter than step C, i.e., about 3 to about 6 seconds and the target temperature is about 20° C. above the target temperature of step B. Typically, no ejection of fluid from the ejection head 10 occurs during step E.

Step B is the steady state fluid ejection step wherein ejection pulses are used. The ejection pulses have a pulse train that includes a pre-fire pulse of 200 to 300 nsec, a dead time of 1200 nsec and a jetting pulse of 700 to 950 nsec. The target temperature for step B is typically about 50° C. In step B, a target volume of fluid (dose) is continuously or intermittently ejected from the ejection head for the duration of step B.

After step B is complete, there may be a waiting period before the next fluid ejection step. If the waiting period is less than about 60 minutes, fluid ejection may be commenced by starting at step E. In other words, steps C and D are generally only used for waiting periods of greater than about 60 minutes. The foregoing times are fluid dependent based on the cooling behavior of the ejection head 10 and the high viscosity fluid contained therein. In cases where sufficient heat remains in the ejection head 10 and fluid and step C is used, overheating of the fluid may lead to drooling as described above, accordingly, step D may again be used to mitigate any drooling of fluid from the ejection head. It will be appreciated that each high viscosity fluid should be independently characterized to ensure that proper temperatures, durations and pulse trains are used according to the above fluid heating and ejection steps illustrated in FIG. 4. Accordingly, various combinations of steps C, D and/or E may be used before the steady state ejection step of step B.

The foregoing procedure illustrated in FIG. 4 may be used to obtain reliable and repeatable fluid ejection of a high viscosity fluid. If the substrate temperature is too low prior to the fluid ejection step B, reliable jetting of fluid from the ejection head 10 may be hampered due to longer fluid refill times or plugging of the flow features in the ejection heads. Longer refill times for fluid to the ejection head 10 may result misfiring from a nozzle, reduced fluid droplet volumes, low fluid ejection velocity, fluid droplet misdirection, and the like. The amount of a typical fluid droplet for a high viscosity ink formulation may range from about 2000 picograms for color inks to about 16,000 picograms for black inks. Corresponding fluid droplet diameters may range from about 14 μm to about 29 μm. Other fluids may have droplet amounts above or below the foregoing amounts depending on the viscosity of the fluid.

In the case where a specific volume of fluid is required to be ejected from the ejection head, the procedure of FIG. 4 mitigates the problem of uncapped startup of the ejection head where some of the nozzles or flow features may be blocked by liquid that is below the desired operating temperature thereby reducing the consistency of a desired dose. Viscous plugs of fluid in the flow features or nozzles are especially difficult to jet out without the aid of the viscosity lowering approach described.

The ejection head temperature curve 36 of FIG. 4 may be tuned with additional variables such as rail voltage, to further enhance the effects of viscosity lowering to enhance start-up of the ejection head and eliminate the need for any nozzle wiping or vacuum maintenance steps during semi-continuous operation of the ejection head. Accordingly, the foregoing procedures may be useful for enabling the ejection head to remain uncapped for longer periods of time when jetting high viscosity fluids.

The foregoing procedures may also be adapted to micro-fluid ejection devices that are used with materials that are solid between about 20° and about 30° C. Such solid materials may be melted in the fluid container adjacent to the ejection head using a heating device so that the materials flow to the ejection head at a viscosity that is above about 20 mPa-sec. Accordingly, the procedure described herein may be used to reliably and repeatably eject materials from an ejection head that are initially in solid form.

It is contemplated, and will be apparent to those skilled in the art from the preceding description and the accompanying drawings, that modifications and changes may be made in the embodiments of the disclosure. Accordingly, it is expressly intended that the foregoing description and the accompanying drawings are illustrative of exemplary embodiments only, not limiting thereto, and that the true spirit and scope of the present disclosure be determined by reference to the appended claims.

What is claimed is:

1. A method for ejecting fluids having a viscosity ranging from about 20 mPa-sec to about 100 mPa-sec at 22° C. from a micro-fluid ejection head, the method comprising the steps of:

determining (1) if a temperature of the ejection head is below 30° C., (2) if the ejection head has been idle for about 60 minutes or more, or (3) if the ejection head is filled with the fluid having a viscosity ranging from about 20 mPa-sec to about 100 mPa-sec at 22° C., and applying a pre-heat signal to the ejection head for a period of time ranging from about 30 to about 60 seconds when one of the conditions (1), (2) or (3) is determined to be present, providing a fluid ejection signal to ejection heaters on the ejection head subsequent to the pre-heat signal to eject drooling fluid from the ejection head, applying a heat signal to the ejection head for a first period of time to heat the ejection head to a first temperature that is about 20° C. above a fluid ejection temperature for continuous or intermittent fluid ejection from the ejection head; and subsequently, applying a firing signal to ejection heaters on the ejection head during which fluid ejection from the ejection head occurs.

2. The method of claim 1, wherein the heat signal is provided to one or more substrate heaters to heat the ejection head to the first temperature.

3. The method of claim 1, wherein the first period of time ranges from about 3 to about 6 seconds.

4. The method of claim 1, wherein the ejection head temperature is determined using temperature sensors on the ejection head.

5. The method of claim 1, wherein the fluid ejection signal has a pre-fire pulse of 250 to 350 nsec, a dead time of about 1200 nsec, and a firing pulse of 750 to 1000 nsec.

6. The method of claim 5, wherein the fluid ejection signal has a duration of from about 3 to about 6 seconds.

7. The method of claim 1, wherein the firing signal is applied to the ejection heaters with a frequency ranging from about 1 to about 5 kilohertz.

8. The method of claim 7, wherein the firing signal has a pre-heat pulse of about 200 to about 300 nanoseconds (nsec) a dead time of about 1200 nsec and a firing pulse ranging from about 700 to about 950 nsec.

9. The method of claim 1, wherein the pre-heat signal is applied to the ejection head using one or more substrate heaters.

10. The method of claim 9, wherein the pre-heat signal is applied to the ejection head to heat the ejection head to a temperature ranging from about 60 to about 100° C.

11. A method for ejecting a high viscosity fluid for a first time from a micro-fluid ejection head or after an ejection head idle period of 60 minutes or more; comprising the steps of:

pre-heating the ejection head to a temperature ranging from about 60° C. to about 100° C. and maintaining the temperature for a first period of time ranging from about 30 to about 60 seconds by applying a pre-heat signal to one or more substrate heaters on the ejection head;

applying a fluid ejection signal to the ejection head subsequent to the pre-heat signal to eject drooling fluid from the ejection head, wherein the fluid ejection signal has a pre-fire pulse of 250 to 350 nanoseconds (nsec), a dead time of 1200 nsec, and a firing pulse 750 to 1000 nsec;

subsequently, applying a heat signal to the one or more substrate heaters on the ejection head for a period of time ranging from about 3 to about 6 seconds to heat the ejection head to a temperature that is about 20° C. above a fluid ejection temperature for continuous or intermittent fluid ejection from the ejection head; and subsequently, applying a firing signal to the ejection heaters on the ejection head during which fluid ejection from the ejection head occurs.

12. The method of claim 11, wherein the firing signal has a pre-heat pulse of 200 to about 300 nanoseconds (nsec) a dead time of about 1200 nsec and a firing pulse of 700 to about 950 nsec.

13. The method of claim 11, wherein the high viscosity fluid has a viscosity ranging from about 20 mPa-sec to about 100 mPa-sec at 22° C.

14. The method of claim 11, wherein the fluid ejection signal has a duration of from about 3 to about 6 seconds.

15. The method of claim 14, wherein the firing signal applied to the ejection heaters is applied with a frequency ranging from about 1 to about 5 kilohertz.

* * * * *